US009316081B2

(12) United States Patent
Hanna

(10) Patent No.: US 9,316,081 B2
(45) Date of Patent: Apr. 19, 2016

(54) WELL CAPPING ASSEMBLY AND METHOD OF CAPPING UNDERWATER WELL

(71) Applicant: CONOCOPHILLIPS COMPANY, Houston, TX (US)

(72) Inventor: Shaddy Youssef Hanna, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/684,986

(22) Filed: Apr. 13, 2015

(65) Prior Publication Data

US 2015/0308210 A1 Oct. 29, 2015

Related U.S. Application Data

(60) Provisional application No. 61/983,294, filed on Apr. 23, 2014.

(51) Int. Cl.
*E21B 33/035* (2006.01)
*E21B 41/04* (2006.01)
*E21B 43/01* (2006.01)

(52) U.S. Cl.
CPC ..... *E21B 33/035* (2013.01); *E21B 41/04* (2013.01); *E21B 43/0122* (2013.01)

(58) Field of Classification Search
CPC ... E21B 33/037; E21B 43/0122; E21B 43/01; E21B 33/043; E21B 33/035
USPC ..... 166/75.13, 339, 345, 352, 356, 363, 166/364, 367–380, 79.1, 81.1, 97.1
See application file for complete search history.

(56) References Cited

U.S. PATENT DOCUMENTS 3,653,215 A * 4/1972 Crucet ..... E21B 43/0122 210/121
3,667,605 A * 6/1972 Zielinski ..... E21B 43/0122 210/170.11
4,323,118 A * 4/1982 Bergmann ..... E21B 33/02 166/356
4,324,505 A * 4/1982 Hammett ..... E21B 19/002 210/922
4,372,527 A 2/1983 Rosenhauch et al.
4,417,624 A * 11/1983 Gockel ..... E21B 19/002 166/343
4,744,698 A 5/1988 Dallimer et al.
6,666,278 B2 * 12/2003 Cicanese ..... A62C 3/02 169/30
7,380,614 B1 6/2008 Williamson et al.
8,540,031 B2 * 9/2013 Rimi ..... F16L 55/115 166/344
8,776,706 B2 * 7/2014 Baylot ..... B63B 27/08 114/331
8,826,990 B2 * 9/2014 Botich ..... E21B 33/035 166/338

(Continued)

FOREIGN PATENT DOCUMENTS

WO 2014070521 5/2014
WO 2015026778 2/2015

OTHER PUBLICATIONS

International Search Report. PCT/US15/25570 Dated Jul. 2, 2015.

*Primary Examiner* — James G Sayre
(74) *Attorney, Agent, or Firm* — ConocoPhillips Company

(57) ABSTRACT

A well capping assembly includes a well cap structure configured to operatively couple to a wellhead structure for capping a fluid flow from a well. Also included is a capping frame operatively coupled to the well cap structure and configured to translate the well cap structure in at least one direction. Further included is a capping structure operatively coupled to the capping frame, the capping structure configured to be submerged in water and rigidly anchored to a sea floor surface.

5 Claims, 6 Drawing Sheets

(56) References Cited

U.S. PATENT DOCUMENTS

| | | | | |
|---|---|---|---|---|
| 8,950,500 | B2 * | 2/2015 | Lieske, II | E21B 43/0122 166/358 |
| 2006/0225810 | A1 | 10/2006 | Baylot et al. | |
| 2011/0240303 | A1 | 10/2011 | Hallundbaek | |
| 2011/0297390 | A1 * | 12/2011 | Kocaman | E21B 33/134 166/360 |
| 2012/0018165 | A1 | 1/2012 | Crossley et al. | |
| 2012/0125623 | A1 * | 5/2012 | Cargol, Jr. | E21B 43/0122 166/344 |

* cited by examiner

WELL CAPPING ASSEMBLY AND METHOD OF CAPPING UNDERWATER WELL

CROSS REFERENCE TO RELATED APPLICATIONS

This application claims benefit of U.S. Patent Application Ser. No. 61/983,294 filed Apr. 23, 2014 entitled "WELL CAPPING ASSEMBLY AND METHOD OF CAPPING UNDERWATER WELL," which is hereby incorporated by reference.

FIELD OF THE INVENTION

This invention relates to underwater wells and, more particularly, to a well capping assembly, as well as a method of capping such underwater wells.

BACKGROUND OF THE INVENTION

In offshore drilling operations, certain structures may be situated proximate a wellhead at a sea floor surface. For example, a blowout preventer (BOP) or connector may be installed on a wellhead at the sea floor. In the event that the well is not adequately sealed, a blowout may occur. The blowout may damage subsea equipment and/or connections between subsea equipment. This can be especially problematic if it results in the discharge of hydrocarbons into the surrounding sea water. In the event such a subsea blowout results in the discharge of hydrocarbons into the surrounding sea, the amount of time it takes to cap and/or shut-in the well is important (i.e., the more time it takes, the more hydrocarbons are discharged into the surrounding water).

The industry has been moving to obtain capabilities to respond to uncontrolled subsea wells. Capping devices are being built as an effective device to cap and contain the well. They are typically deployed from the surface of the water over the incident wells in water depths up to several thousand feet. However, as the water depth gets shallower (e.g., hundreds of feet or less), responding to an uncontrolled well poses unique challenges. For example, the hydrocarbons at the surface will be thicker and more concentrated, as there is less water depth (i.e., space) for dilution to occur. Additionally, a plume will cause the hydrocarbons to spread over a wider area at the water surface and the plume will not disperse away from the incident well location. Further, a blowout may cause a fire to remain in the area where the well is. Each of these factors contributes to the difficulty of capping the well using standard installation techniques from the surface, as is typically done in deeper water events.

SUMMARY OF THE INVENTION

In one embodiment of the invention, a well capping assembly includes a well cap structure configured to operatively couple to a wellhead structure for capping a fluid flow from a well. Also included is a capping frame operatively coupled to the well cap structure and configured to translate the well cap structure in at least one direction. Further included is a capping structure operatively coupled to the capping frame, the capping structure configured to be submerged in water and rigidly anchored to a sea floor surface.

In another embodiment of the invention, a method of capping an underwater well is provided. The method includes deploying a capping structure into a body of water at an offset position from the underwater well. The method also includes floating the capping structure with at least one buoyancy tank.

The method further includes submerging the capping structure. The method yet further includes positioning the capping structure over the underwater well. The method also includes rigidly anchoring the capping structure to a sea floor surface. The method further includes maneuvering a well cap structure in at least one direction with a capping frame that is operatively coupled to the capping structure. The method yet further includes capping a fluid flow from the underwater well upon operatively coupling the well cap structure to a wellhead structure.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the invention without departing from the scope or spirit of the invention. For instance, features illustrated or described as part of one embodiment can be used on another embodiment to yield a still further embodiment. Thus, it is intended that the invention cover such modifications and variations that come within the scope of the appended claims and their equivalents.

Figure 1:
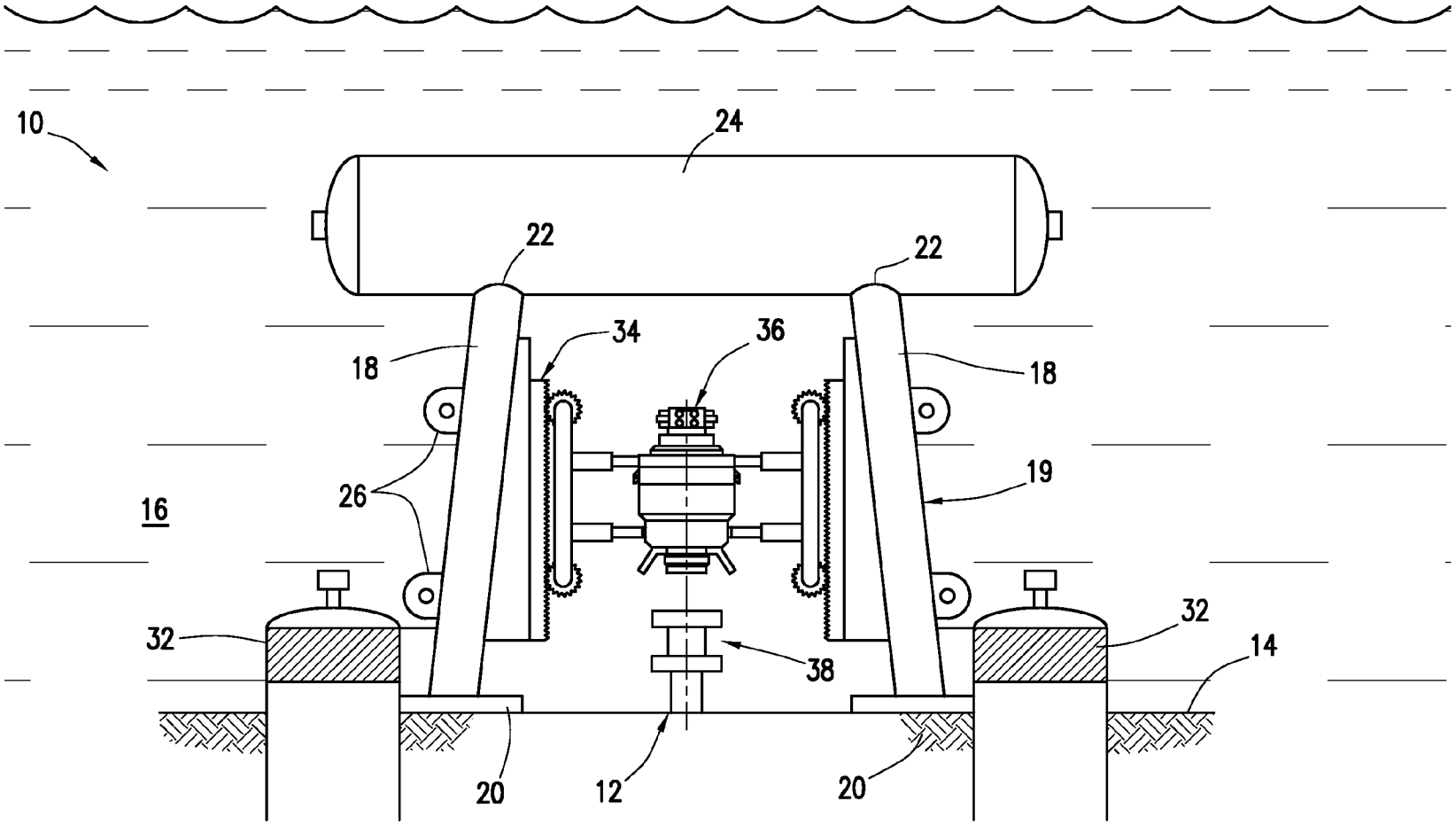
FIG. 1 is a side view of a well capping assembly configured to interact with a wellhead structure positioned on a sea floor surface.

Referring to FIG. 1, a well capping assembly is illustrated and generally referenced with numeral 10. The well capping assembly 10 is employed in offshore locations where drilling for hydrocarbons has occurred. In particular, the well capping assembly 10 is configured to assist with capping a wellhead 12 located underwater proximate a sea floor surface 14 of a body of water 16 and may be used to control a fluid flow from the wellhead 12. The well capping assembly 10 is particularly suitable for shallow water drilling sites. In one embodiment, the suitable water depth for which the well capping assembly 10 is employed is about 500 feet (about 152 meters) or less. This is in contrast to deepwater drilling sites that are often present in locations having a water depth of several thousand feet. Shallower water poses well capping issues that are unique to shallow water applications and the well capping assembly 10 illustrated and described herein is suited to meet those issues. However, it is contemplated that the embodiments described herein may be employed in deep water applications.

The well capping assembly 10 includes a capping structure 19 having at least one, but typically a plurality of legs 18 extending from a first end 20 to a second end 22. Although the side view of FIG. 1 depicts two legs, in one embodiment, four legs are included and are disposed at outward angles to each other. The first end 20 of the plurality of legs 18 is configured to engage the sea floor surface 14 in a final capping position. The second end 22 of each of the plurality of legs 18 are operatively coupled, or integrally formed with one or more buoyancy tanks 24 that are configured to provide a buoyancy force to facilitate floating of the well capping assembly 10 at the surface of the body of water 16 upon initial deployment of the well capping assembly 10 into the body of water 16. In one embodiment, two buoyancy tanks are included, with the second end 22 of two legs coupled to each tank. The capping structure 19 may be formed of various suitable materials. In one embodiment, the capping structure 19 at least partially formed of steel.

Irrespective of the precise number of legs and buoyancy tanks, the well capping assembly 10 is configured to be deployed into the body of water 16 at an offset position, with respect to a location directly above the wellhead 12. Deployment of the well capping assembly 10 at the offset position avoids exposure of the well capping assembly 10 to various potential harmful conditions that are present at the surface of the body of water 16 in a region directly over the wellhead 12.

Each of the plurality of legs 18 of the capping structure 19 includes one or more cable engagement components 26, such as a bracket or the like to attach one or more cables 28 (shown in FIGS. 3-5) to the capping structure 19. The one or more cables 28 are mooring lines that are attached to respective vessels 30 (FIGS. 3-5) that are configured to control, at least in part, the position of the well capping assembly 10. At least one suction pile 32 is mounted proximate the first end 20 of the plurality of legs 18. The at least one suction pile 32 is configured to be driven into the sea floor surface 14 in order to rigidly anchor the well capping assembly 10 to the sea floor surface 14. The at least one suction pile 32 may be mounted to the plurality of legs 18 proximate the first end 20, as described above, or alternatively may form the first end 20 of some or all of the plurality of legs 18.

The well capping assembly 10 also includes a capping frame 34 and a well cap structure 36. As shown, in a final position of the well capping assembly 10, the well cap structure 36 is located directly above a wellhead structure 38 disposed proximate the wellhead 12 at the sea floor surface 14. The wellhead structure 38 may be numerous structures commonly employed in drilling operations. For example, the wellhead structure 38 may be a blowout preventer (BOP) or a connector. The wellhead structure 38 is generically illustrated, but it is to be appreciated that numerous structures may be capped with the well cap structure 36 of the well capping assembly 10.

Figure 2:
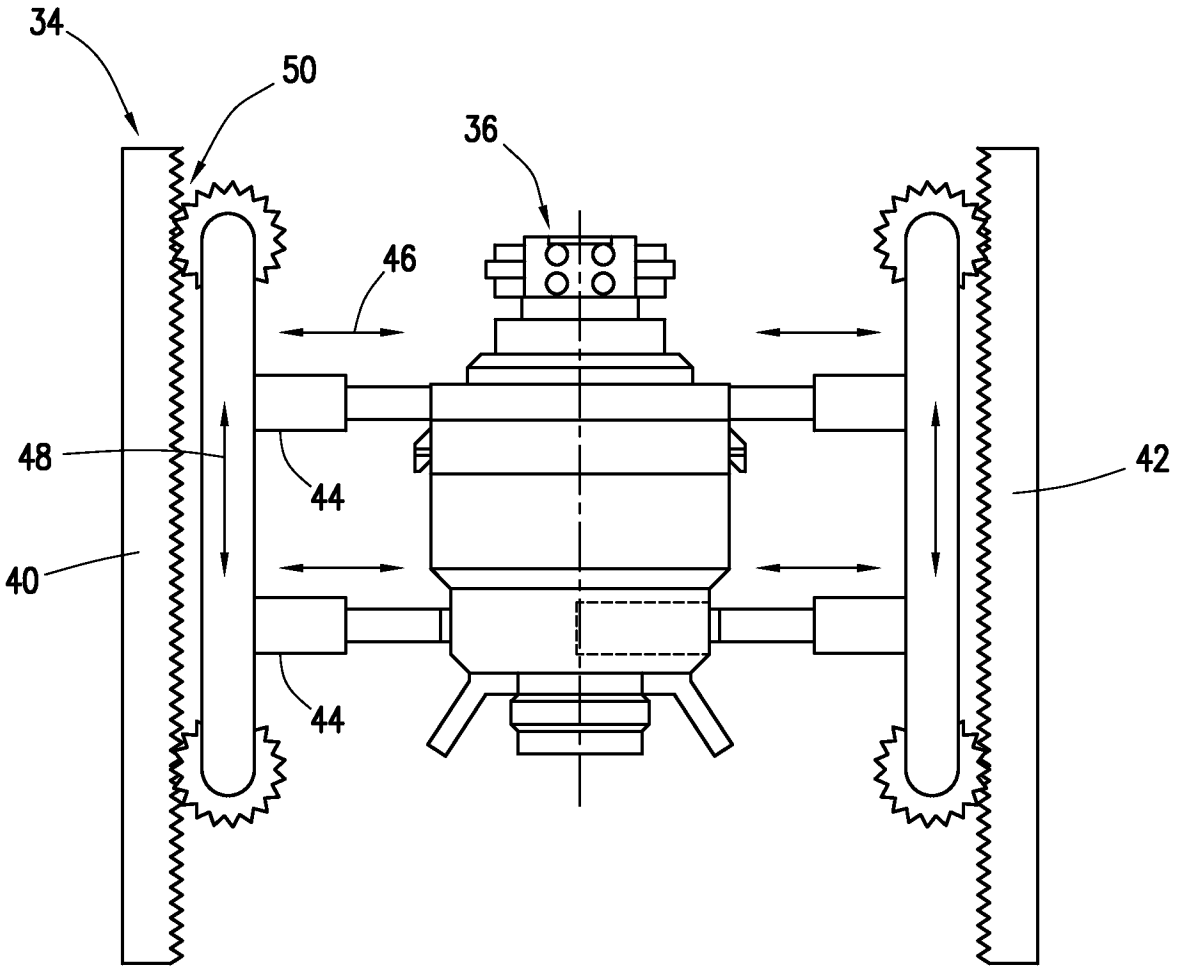
FIG. 2 is a side view of a well cap frame and a well cap structure of the well capping assembly.

Referring now to FIG. 2, the capping frame 34 and the well cap structure 36 are illustrated in greater detail. The capping frame 34 may be formed in numerous varying geometries, but regardless of the particular orientation it is configured to be operatively coupled to the well cap structure 36. The capping frame 34 and the well cap structure 36 are configured in a manner that facilitates positional control of the well cap structure 36 via manipulation by the capping frame 34. The operative connection and precise manner of control of the well cap structure 36 may be accomplished in numerous suitable mechanical and/or electromechanical manners.

In the illustrated embodiment, the capping frame 34 includes a first side member 40 and a second side member 42 spaced from one another, with each operatively coupled to the capping structure 19 at respective legs of the plurality of legs 18. The first side member 40 and the second side member 42 may be secured to the plurality of legs 18 in any suitable manner, including via mechanical fasteners, welded, or integrally formed with the plurality of legs 18, for example. It is to be appreciated that although two side members are illustrated and described above, it is contemplated that a single side member may be used to support and control the well cap structure 36. Further, certainly more than two side members may be included.

In the exemplary embodiment, the capping frame 34 includes at least one, but typically a plurality of arms 44 that engage and couple the well cap structure 36 to the capping frame 34. The plurality of arms 44 may comprise hydraulic cylinders or linkages, for example. Each of the plurality of arms 44 is moveable to dictate positional control of the well cap structure 36 in a direction 46. Movement of the each of the plurality of arms 44 is made in conjunction with one another to accomplish positional control in the direction 46. In an embodiment having multiple arms, as shown, one or more of the arms may be actuated in a manner that controls the angular orientation of the well cap structure 36.

In addition to facilitating positional control of the well cap structure 36 in the direction 46 and the angular orientation of the well cap structure 36, the capping frame 34 is configured to control the position of the well cap structure 36 in a direction 48 that corresponds to water depth within the body of water 16. The direction 48 is substantially perpendicular to the direction 46. Positional control of the well cap structure 36 in the direction 48 may be accomplished in numerous contemplated manners. In the illustrated embodiment, a rack and pinion arrangement 50 is employed to translate the well cap structure 36 in the direction 48. Alternatively, the plurality of arms 44 may simply interact with the first side member 40 and the second side member 42 to establish translation of the well cap structure 36, such as by riding within tracks of the first side member 40 and the second side member 42.

Figure 3:
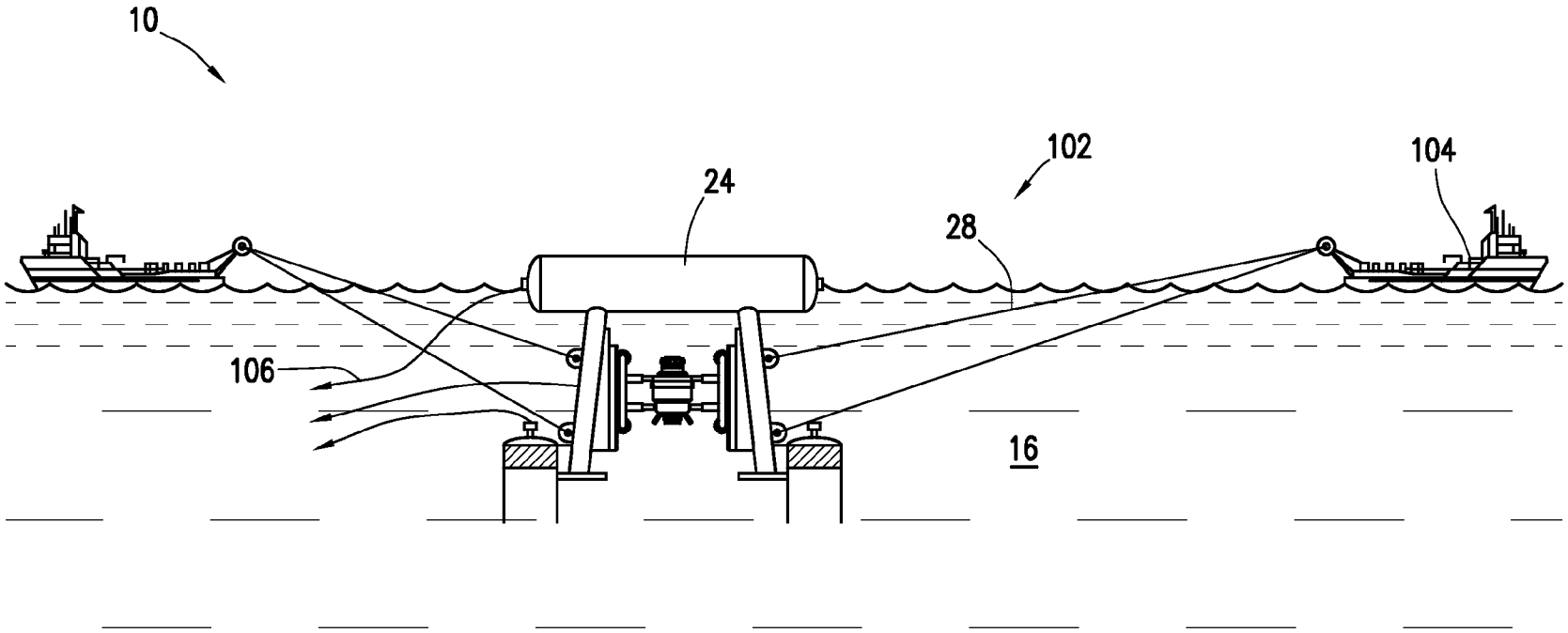
FIG. 3 is a side view of the well capping assembly in a first position, illustrating a method of capping an underwater well.

The well capping assembly 10 may be characterized as a remotely operated underwater vehicle (ROV) that is operated remotely via at least one control line (FIG. 3). In other words, some or all of the elements of the well capping assembly 10 described above may be remotely operated and controlled from a remote location, such as a vessel located at the surface of the body of water 16. Remote operations include, but are not limited to the positional control of the well cap structure 36 with the capping frame 34, operation of the at least one suction pile 32, and buoyancy control of the one or more buoyancy tanks 24. Remote operation of the well capping assembly 10 is particularly advantageous for the embodiments described herein, as the well capping assembly 10 is deployed at an offset location from the wellhead 12 and subsequently maneuvered to a submerged, mid-depth location in the body of water 16. The method of operation will be appreciated from the description below.

Figure 4:
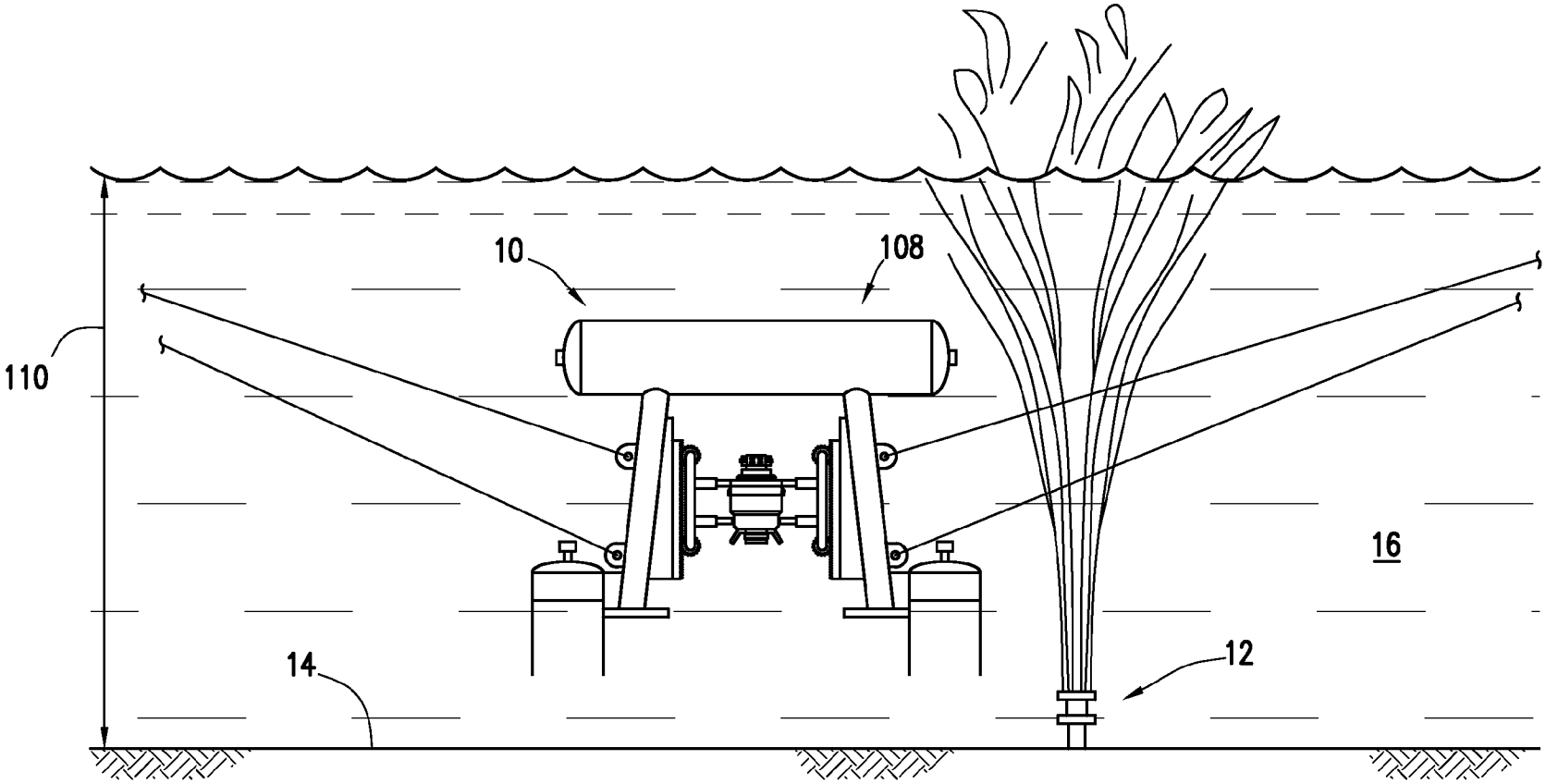
FIG. 4 is a side view of the well capping assembly in a second position, illustrating the method of capping the underwater well.
Figure 5:
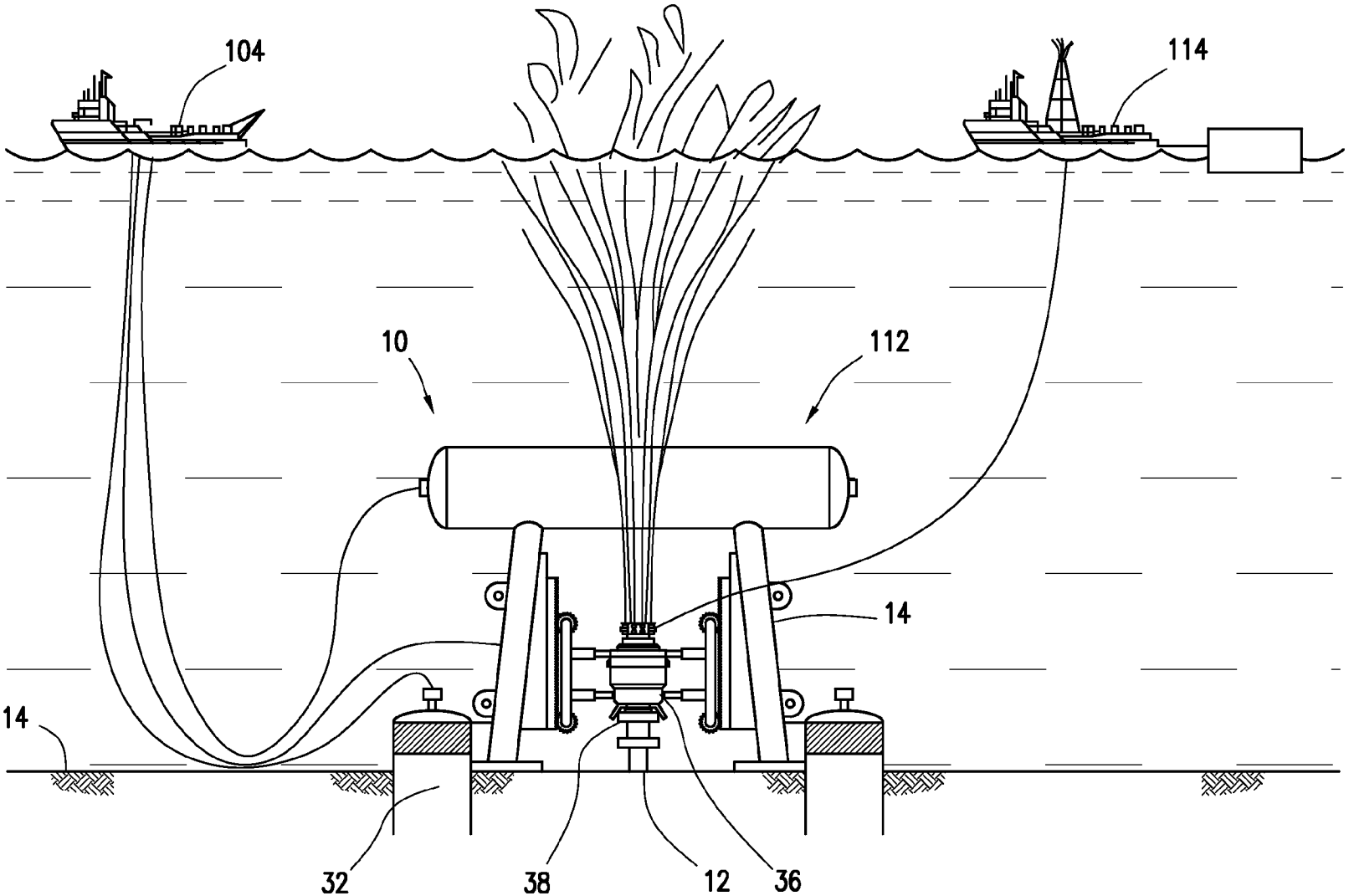
FIG. 5 is a side view of the well capping assembly in a third position, illustrating the method of capping the underwater well.

Referring now to FIGS. 3-5, which depict detail of the well capping assembly 10 in various stages of a method of capping an underwater well 100. The well capping assembly 10, including the capping structure 19, the capping frame 34 and the well cap structure 36, has been previously described and specific structural components need not be described in further detail.

FIG. 3 illustrates the well capping assembly 10 in an initial deployment position 102. In the initial deployment position 102, the well capping assembly 10 is positioned at an offset location within the body of water 16, relative to a position directly above the wellhead 12. In this position, the one or more buoyancy tanks 24 provide a buoyancy force strong enough to maintain floatation of the one or more buoyancy tanks 24 at the surface of the body of water 16, thereby keeping the well capping assembly 10 in close proximity to the surface. In the initial deployment position 102, the well capping assembly 10 is attached to at least one, but typically a plurality of vessels 104 via the one or more cables 28 (e.g., mooring lines). Additionally, at least one, but typically a plurality of control lines 106 is connected to various components of the well capping assembly 10 to establish remote control capabilities, as described in detail above. In addition to maneuvering and maintaining the well capping assembly 10 in a desirable offset position, the mooring lines are positioned with the vessels 104 to avoid potentially harmful conditions at the surface of the body of water 16 that may be present directly over the wellhead 12.

FIG. 4 shows the well capping assembly 10 in a mid-depth position 108. The mid-depth position 108 is achieved by slowly lowering the well capping assembly 10 from the surface to an intermediate depth of the body of water 16. The well capping assembly 10 is maintained in the offset position, relative to a position directly above the wellhead 12. The precise depth of the mid-depth position 108 depends on the overall water depth 110 and the conditions within the body of water 16. In particular, potentially harmful conditions that may be present directly above the wellhead 12 at and near the surface of the body of water 16 are avoided by lowering the well capping assembly 10 to a desirable depth.

FIG. 5 illustrates the well capping assembly 10 in a final capping position 112 corresponding to rigid anchoring of the capping structure 19 to the sea floor surface 14. As described above, anchoring is typically achieved with the at least one suction pile 32. In the final capping position 112, the well capping assembly 10 is disposed directly over the wellhead 12. As such, the well capping assembly 10 has been maneuvered from the offset position previously maintained to the final capping position 112. Upon anchoring of the capping structure 19, the capping frame 34 maneuvers the well cap structure 36 in a manner described in detail above. Positioning of the well cap structure 36 facilitates engagement and operative coupling of the well cap structure 36 to the wellhead structure 38 located proximate the wellhead 12 at the sea floor surface 14. Once the well cap structure 36 and the wellhead structure 38 are fully engaged, the well capping assembly 10 is configured to shut down the fluid flow, such as oil and/or gas, or diverting it to offload vessel 114.

As noted above, some or all of the above-described operations are carried out remotely via the plurality of control lines 106 that are connected to various components of the well capping assembly 10.

Figure 6:
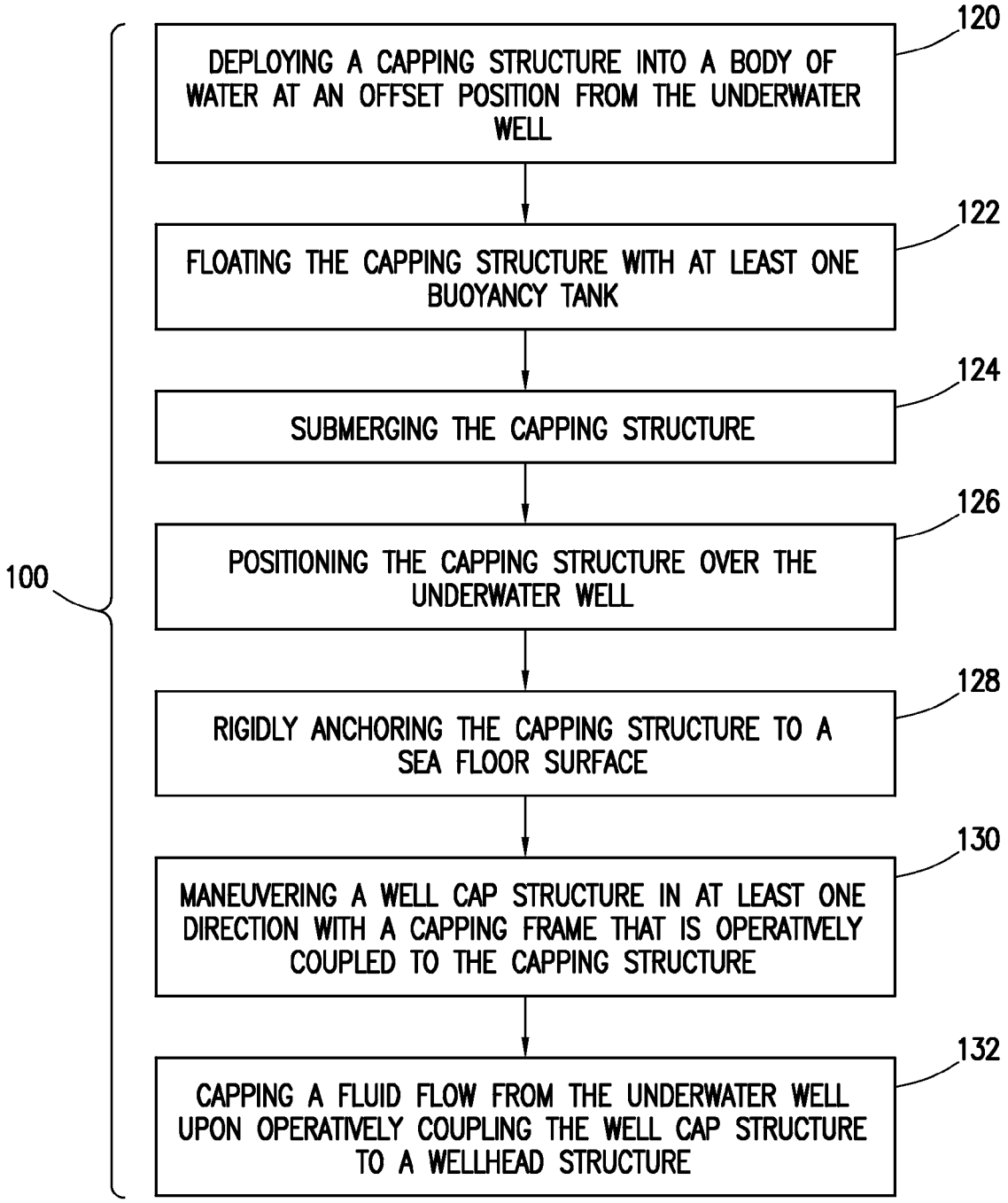
FIG. 6 is a flow diagram further illustrating an embodiment of the method of capping the underwater well.

Referring to FIG. 6, and with reference to FIGS. 1-5, an embodiment of the method of capping an underwater well 100 is illustrated as a flow diagram. The method 100 includes deploying a capping structure into a body of water at an offset position from the underwater well 120. The capping structure is floated with at least one buoyancy tank 122, submerged 124, and positioned over the underwater well 126. The capping structure is rigidly anchored to a sea floor surface 128. A well cap structure is maneuvered in at least one direction with a capping frame that is operatively coupled to the capping structure 130. A fluid flow is capped upon operatively coupling of the well cap structure to a wellhead structure 132.

Advantageously, the above-described embodiments, provide an offset, mid-depth installation structure and method by which capping devices can be deployed and secured over uncontrolled subsea wells, which is particularly beneficial in shallow water well drilling sites.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of capping an underwater well comprising:

deploying a capping structure into a body of water at an offset position from the underwater well;

floating the capping structure with at least one buoyancy tank;

submerging the capping structure;

positioning the capping structure over the underwater well after the submerging, wherein the deploying and the positioning utilize first and second vessels attached to the capping structure with a plurality of mooring lines and the vessels remain on opposing sides offset from directly over the well to avoid placement of the mooring lines, the vessels and the capping structure at a surface of the body of water directly above the well throughout the deploying and the positioning;

rigidly anchoring the capping structure to a sea floor surface;

maneuvering a well cap structure in at least one direction with a capping frame that is operatively coupled to the capping structure; and capping a fluid flow from the underwater well upon operatively coupling the well cap structure to a wellhead structure.

2. The method of claim 1, wherein rigidly anchoring comprising inserting at least one suction pile into the sea floor surface.

3. The method of claim 1, further comprising remotely operating one or more components of at least one of the capping structure, the capping frame, and the well cap structure.

4. The method of claim 1, wherein maneuvering the well cap structure comprises translating the well cap structure in a first direction and a second direction that is substantially perpendicular to the first direction, and angularly manipulating the well cap structure.

5. The method of claim 1, further comprising shutting down the fluid flow from the underwater well or diverting it to an offload vessel.

* * * * *